US005480028A

United States Patent [19]

Robinson

[11] Patent Number: 5,480,028

[45] Date of Patent: Jan. 2, 1996

[54] STACKABLE PLASTIC CONTAINER PACKAGE

[75] Inventor: Gerald R. Robinson, Perrysburg, Ohio

[73] Assignee: Owens-Illinois Plastic Products Inc., Toledo, Ohio

[21] Appl. No.: 163,458

[22] Filed: Dec. 8, 1993

[51] Int. Cl.[6] ..... B65D 21/032

[52] U.S. Cl. ..... 206/511; 215/391; 215/44

[58] Field of Search ..... 215/10, 1 C, 387, 215/390, 391, 43, 44; 266/509, 510, 511

[56] References Cited

U.S. PATENT DOCUMENTS

| | | | |
|---|---|---|---|
| 526,772 | 10/1894 | Dickerson . | |
| 1,370,665 | 3/1921 | Moore . | |
| 1,737,744 | 12/1929 | Wicklein | 215/10 |
| 1,922,967 | 8/1933 | Mandabach . | |
| 1,986,741 | 1/1935 | Moser . | |
| 2,056,171 | 10/1936 | Deschner . | |
| 2,641,374 | 6/1953 | Der Yuen . | |
| 2,661,872 | 12/1953 | Trautvetter . | |
| 2,804,103 | 8/1957 | Wall . | |
| 2,818,204 | 12/1957 | Henchert . | |
| 3,142,422 | 7/1964 | Mojonnier | 206/509 |
| 3,159,298 | 12/1964 | Saw . | |
| 3,191,789 | 6/1965 | Davidson . | |
| 3,214,052 | 10/1965 | Dike . | |
| 3,474,843 | 10/1969 | Maris | 215/10 |
| 3,595,418 | 7/1971 | Adcock . | |
| 3,955,705 | 5/1976 | Dubois . | |
| 4,000,704 | 1/1977 | Griffin, Jr. | 206/511 |
| 4,609,106 | 9/1986 | Gentili | 206/509 |
| 4,616,759 | 10/1986 | Mahler . | |
| 4,632,268 | 12/1986 | Melzi et al. | 206/509 |
| 4,691,818 | 9/1987 | Slusarczyk . | |
| 4,805,793 | 2/1989 | Brandt . | |
| 4,851,351 | 7/1989 | Akamine | 215/10 |
| 4,974,749 | 12/1990 | Mon . | |
| 5,002,199 | 3/1991 | Frahm . | |
| 5,224,635 | 7/1993 | Wise | 206/511 |

FOREIGN PATENT DOCUMENTS

| | | | |
|---|---|---|---|
| 701381 | 1/1965 | Canada | 206/509 |
| 274742 | 7/1988 | European Pat. Off. | 206/510 |
| 1239737 | 7/1960 | France | 206/510 |
| 1355751 | 2/1964 | France | 206/509 |
| 660896 | 7/1965 | France | 206/509 |

*Primary Examiner*—Stephen J. Castellano

[57] ABSTRACT

A stackable plastic container including a body having a generally rectangular cross section including a base wall, sidewalls and end walls, the width of the sidewalls being greater than the width of the end walls. The body has a top wall with an integral neck defining a dispensing opening. The bottom wall has spaced longitudinally extending integral portions defining a longitudinal recess extending lengthwise of the bottom wall and generally parallel to the sidewall. The top wall of the body includes a centrally located longitudinally extending projection extending upwardly and defining spaced longitudinally extending generally horizontal portions lengthwise of the sidewalls such that when one container is stacked on another, the longitudinally extending portions of the top wall are engaged by the longitudinally extending spaced projections on the bottom wall of a container stacked thereon.

5 Claims, 5 Drawing Sheets

STACKABLE PLASTIC CONTAINER PACKAGE

This invention relates to plastic containers and particularly to plastic containers that may be stacked on one another.

BACKGROUND AND SUMMARY OF THE INVENTION

It has been heretofore suggested that containers have been stacked one on another with portions adapted to interengage and provide stability. Typical constructions are: U.S. Pat. No. 2,641,374 showing glass containers; U.S. Pat. No. 2,661,872 showing metal beer kegs; U.S. Pat. No. 3,214,052 showing plastic bottles with handles; U.S. Pat. No. 3,955,705 showing plastic drums; U.S. Pat. No. 4,691,828 showing plastic containers; U.S. Pat. No. 4,805,793 showing plastic blow molded containers; and U.S. Pat. No. 5,002,199 showing plastic containers stackable on their sides.

Among the objectives of the present invention are to provide a stackable plastic container which is light in weight; which can be made by extrusion blow molding or injection extrusion and blow molding; which has closures with measuring capability; and which will effectively permit stacking of one container on another.

In accordance with the invention, a stackable plastic container including a body having a generally rectangular cross section includes a base wall, sidewalls and end walls, the width of the sidewalls being greater than the width of the end walls. The body has a top wall with an integral neck defining a dispensing opening. The bottom wall has spaced longitudinally extending integral portions defining a longitudinal recess extending lengthwise of the bottom wall and generally parallel to the sidewall. The top wall of the body includes a centrally located longitudinally extending projection extending upwardly and defining spaced longitudinally extending generally horizontal portions lengthwise of the sidewalls such that when one container is stacked on another, the longitudinally extending portions of the top wall are engaged by the longitudinally extending spaced projections on the bottom wall of a container stacked thereon.

DESCRIPTION

Figure 1:
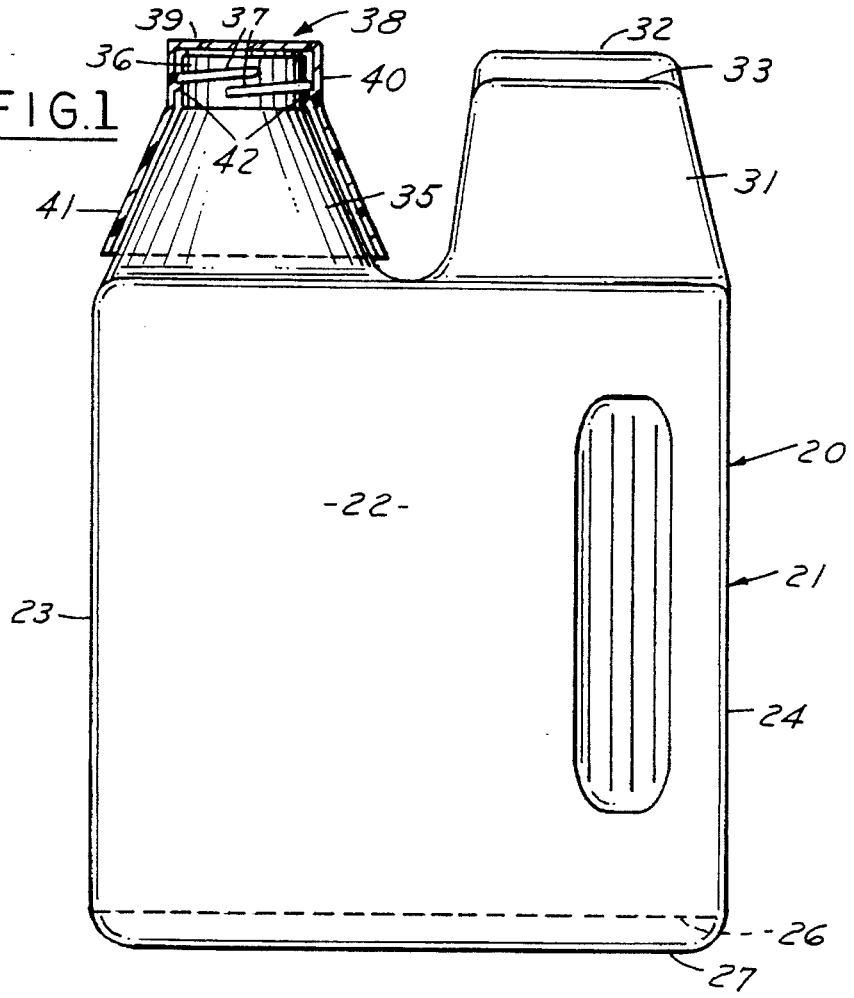
FIG. 1 is a part sectional elevational view of a stackable container embodying the invention.
Figure 2:
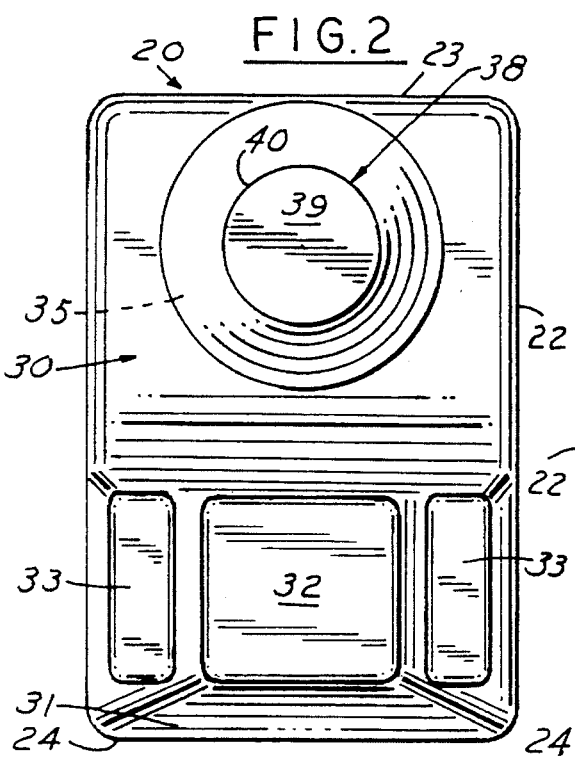
FIG. 2 is a top plan view of the container.
Figure 3:
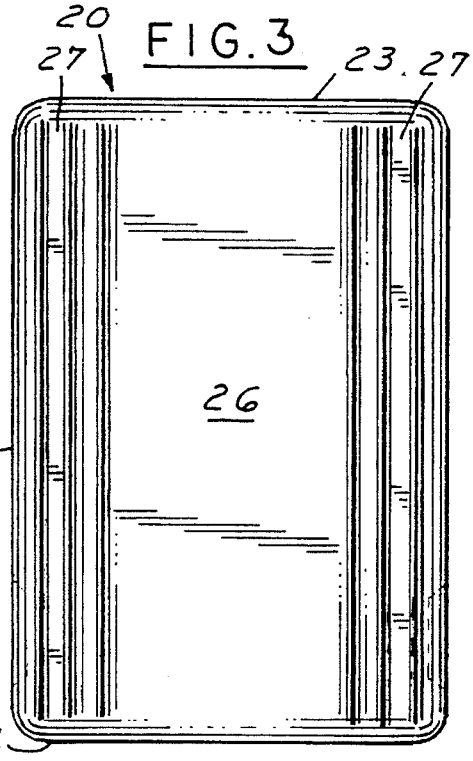
FIG. 3 is a bottom plan view of the container.

Referring to FIGS. 1–3, the plastic container 20 embodying the invention is made of light weight plastic material in relatively thin sections of plastic material such as polyethylene or polypropylene. The container 20 comprises a body 21 that includes generally parallel sidewalls 22 and end walls 23, 24, the width of the sidewalls being greater than the Width of the end walls.

The container further includes a bottom wall 25 that is formed with a longitudinally extending recess 26 defining longitudinally extending parallel downwardly extending projections 27.

The container 20 includes a top wall 30 that has an integral projection 31 extending upwardly from one end as shown at the right in FIG. 1. Projection 31 includes a longitudinally extending outwardly projecting portion 32 that is parallel to the sidewalls 22 and defines longitudinally extending surfaces 33.

The top wall 30 further includes a hollow neck 35 that extends axially upwardly and ends in a finish 36 having external threads 37 onto which a cap 38 is threaded. The cap 38 includes a base wall 39, a peripheral skirt 40 and an integral frustoconical downwardly extending portion 41 which performs the function of a measuring cup when the cap 38 is removed from the finish. The cap includes a thread 42 for engaging the thread 37 on the finish.

The container 20 is preferably made of polyethylene or polypropylene by extrusion blow molding or injection extrusion blow molding.

Figure 4:
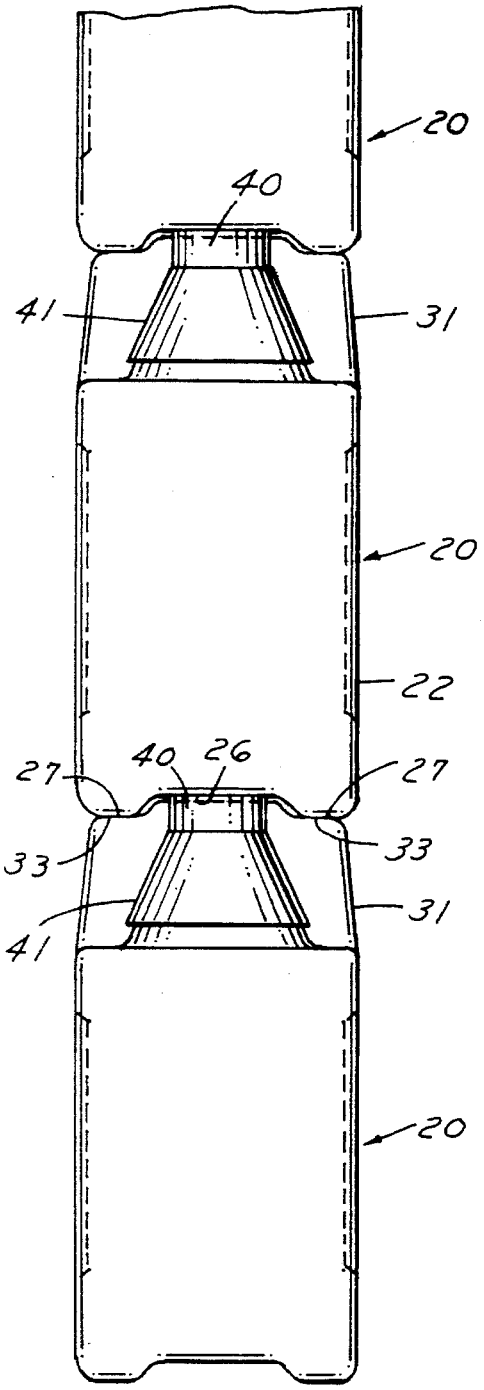
FIG. 4 is a fragmentary view showing stacked containers taken from the left as viewed in FIG. 1.
Figure 5:
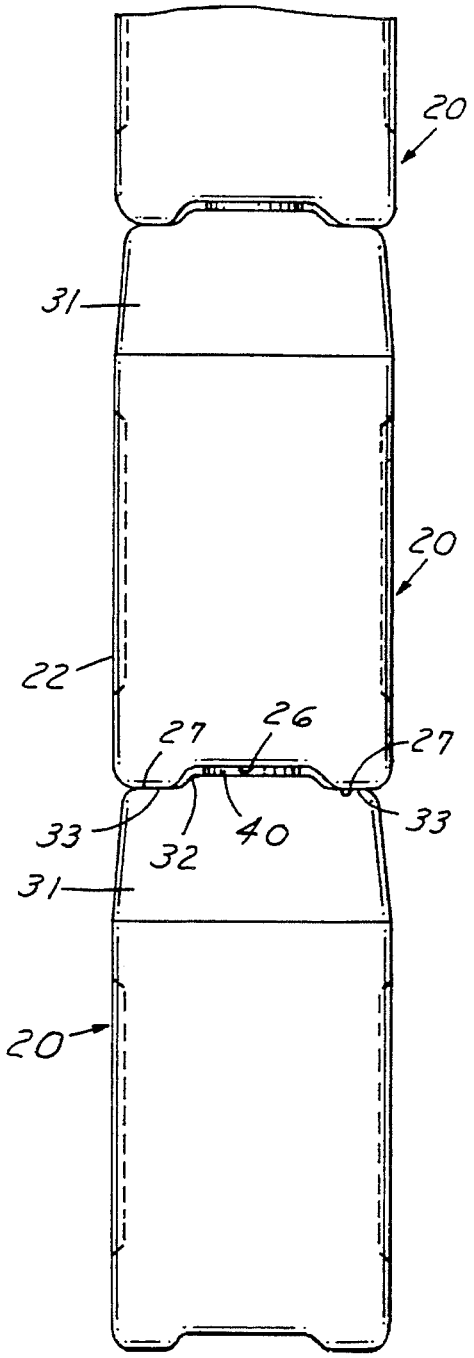
FIG. 5 is a fragmentary view of stacked containers taken from the right as viewed in FIG. 1.

As shown in FIGS. 4 and 5, when one container 20 is stacked on another, the spaced longitudinally extending projections 27 on the bottom wall 25 of the overlying container 20 engage the longitudinally extending surfaces 33 and the recess 26 engages the top wall 39 of the closure 38.

Figure 6:
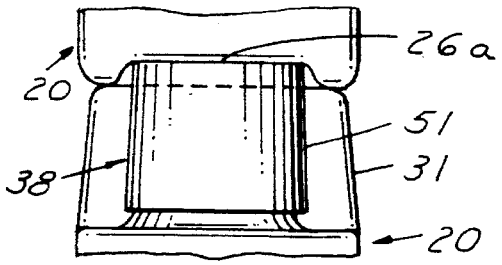
FIG. 6 is a fragmentary end view of a modified form of container.
Figure 7:
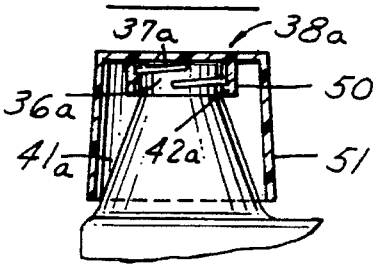
FIG. 7 is part sectional view of the container shown in FIG. 6.

In the form shown in FIGS. 6 and 7, the closure **38*a* includes an inner skirt having threads thereon for engaging the threads of the neck and an outer skirt 51 that provides an overall greater diameter for the closure which engages the recess 36*a* of an overlying container. As in the previous form of the invention, when the closure 38*a*** is inverted, it can be used as a measuring cup.

Figure 8:
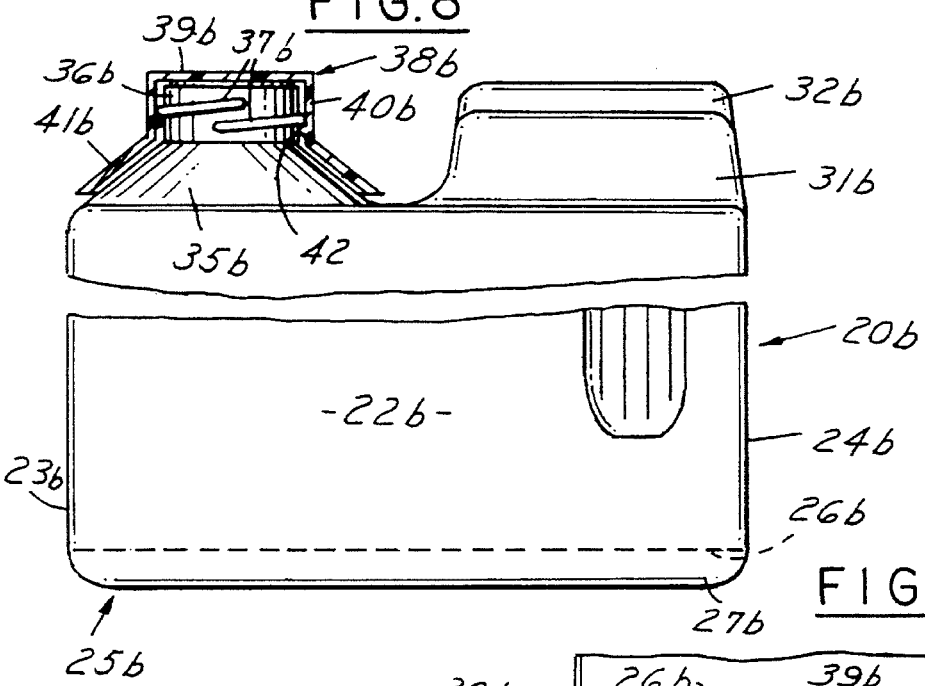
FIG. 8 is a part sectional fragmentary side elevational view of a modified form of container.
Figure 9:
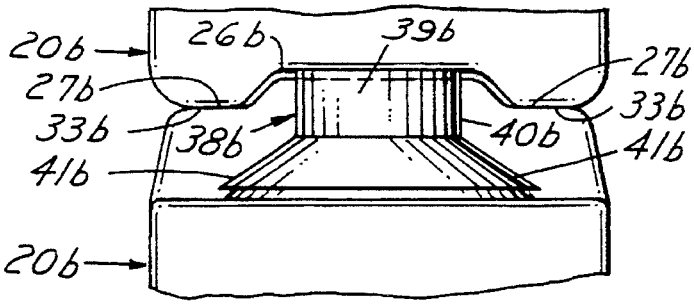
FIG. 9 is an end view of the container shown in FIG. 8 stacked with another identical container taken from the left in FIG. 8.

In the modified form shown in FIGS. 8 and 9 the neck **35*b* has a lesser axial height and the closure has a complementary cross section with the frustoconical portion 41*b* defining a greater angle corresponding to the slope of the neck 35*b***.

Figure 10:
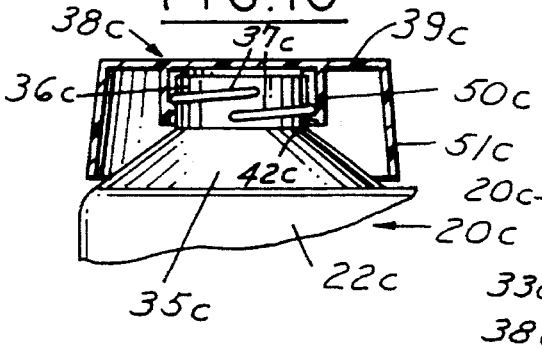
FIG. 10 is a part sectional end view of a container with a modified form of closure.
Figure 11:
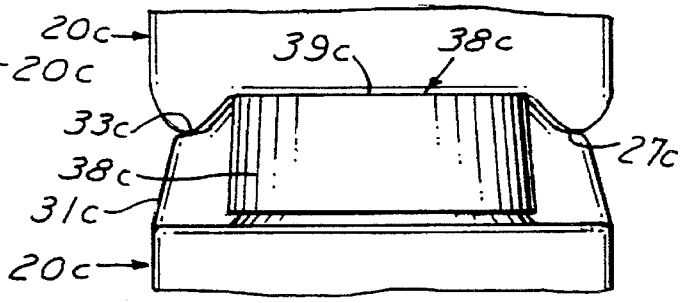
FIG. 11 is an end view of a stack of containers with the closure of the type shown in FIG. 10.
Figure 12:
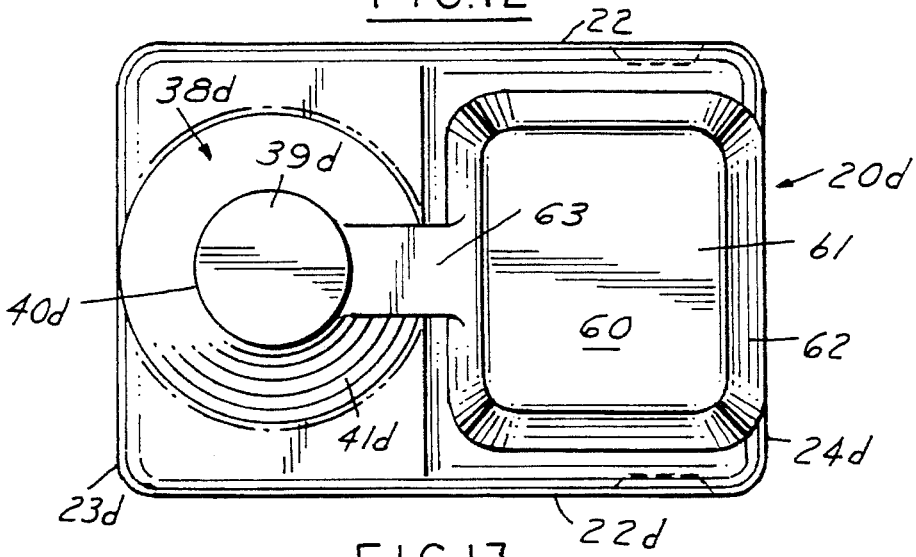
FIG. 12 is a plan view of another modified form of container.

In the form shown in FIGS. 10 and 11 the closure 38*c* is applied to a similar container to that shown in FIGS. 8 and 9 except that it has an inner skirt 50*c* and an outer skirt 51*c* as in the form shown in FIGS. 6 and 7.

In the form of the invention shown in FIGS. 12–15, the closure 38*d* is provided with a measuring function by an integral measuring cup 60 that has a base wall 61 and frustoconical wall 62 and is connected by an integral plastic strap 63 to the closure 38*d* such that the cup 60 is interposed between the spaced projections 27 on the bottom wall and the surfaces 33*d* on the top wall.

Figure 16:
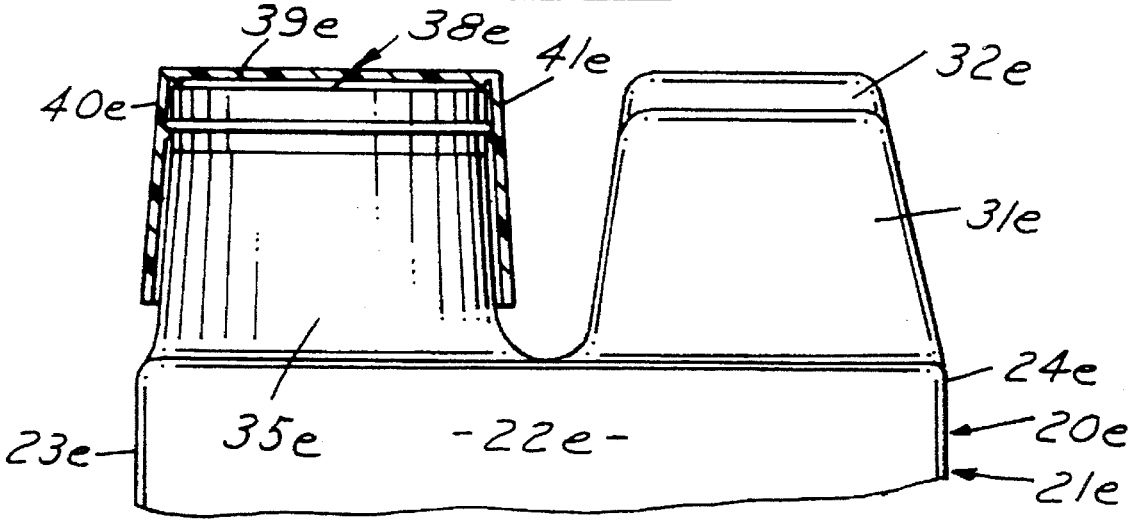
FIG. 16 is a fragmentary part sectional elevational view of a further modified form of a stackable container.

In the form of the invention shown in FIG. 16, the stackable container 20*a* is similar to the container 20 in FIG. 1 except that the closure or cap 38*e* has neck 35*e* with a larger diameter.

Figure 17:
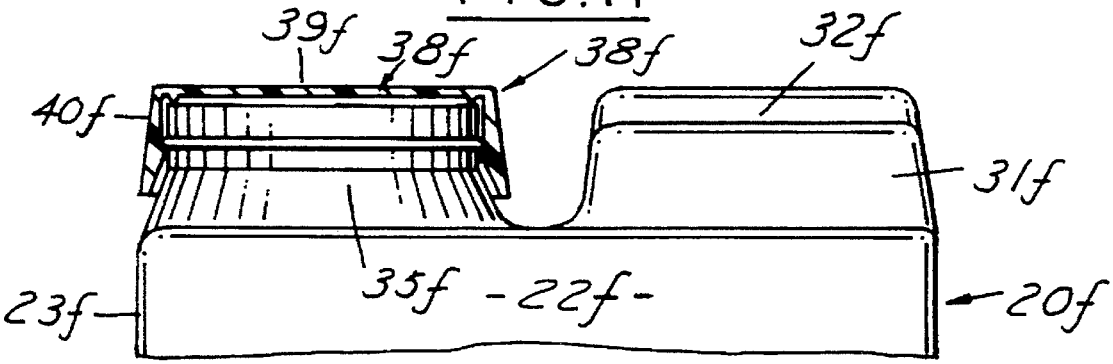
FIG. 17 is a fragmentary sectional view of another modified form of stackable container.

In the form of the invention shown in FIG. 17, the stackable container 20*f* is similar to FIG. 16 except that the neck 35*f* has a lesser height.

Figure 13:
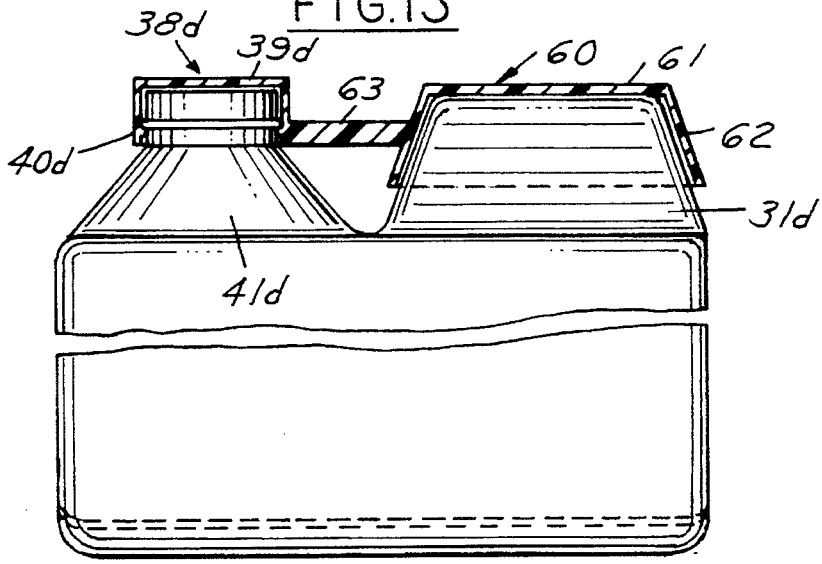
FIG. 13 is a part sectional fragmentary side elevational view of the container shown in FIG. 12.
Figure 14:
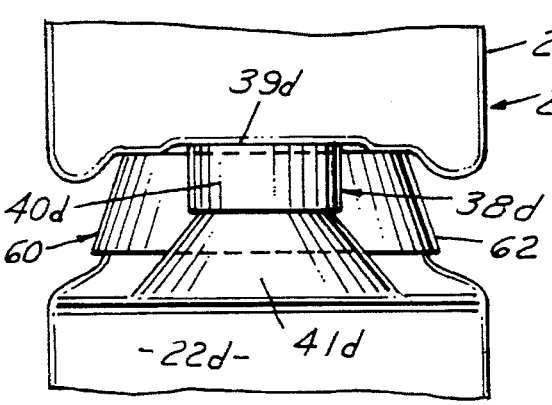
FIG. 14 is an end view of the container shown in FIGS. 12 and 13 in stacked relationship taken from the left as viewed in FIG. 12.
Figure 15:
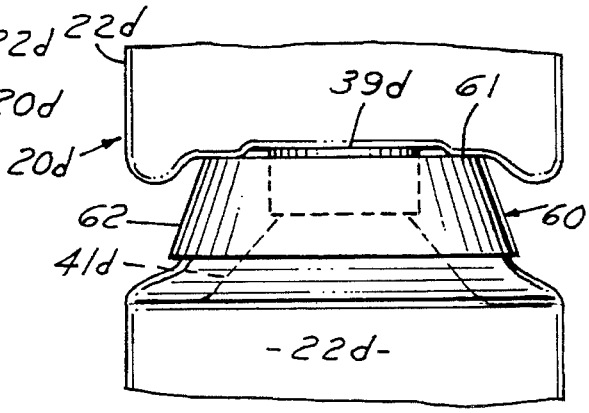
FIG. 15 is a fragmentary stacked view of the container shown in FIG. 14 taken from the right as viewed in FIGS. 12 and 13.
Figure 18:
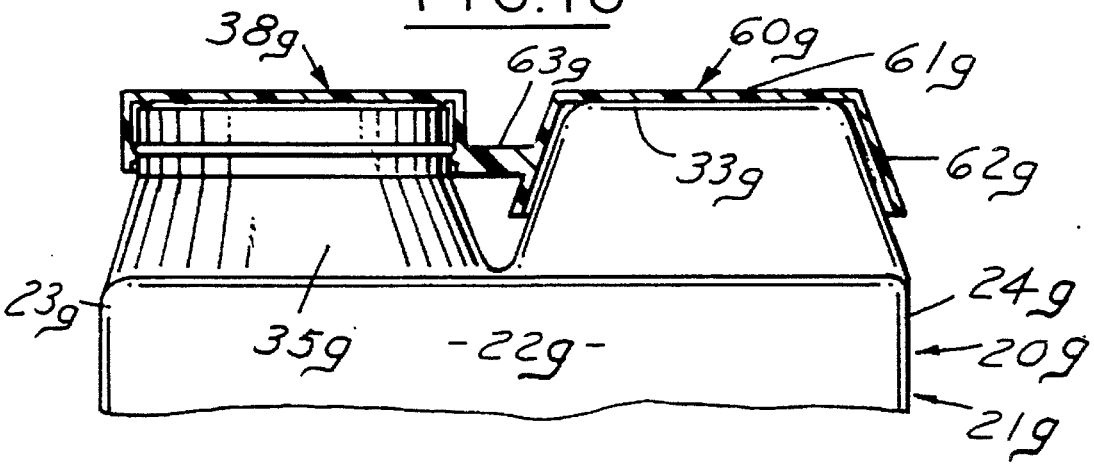
FIG. 18 is a fragmentary sectional view of another modified form of stackable container.

In the form of the invention set forth in FIG. 18, the container 20*g* is similar to that shown in FIG. 13 except that the neck 35*g* has a larger diameter.

It can thus be seen that there has been provided a stackable plastic container which is light in weight; which can be made by extrusion blow molding or injection extrusion and blow molding; which has closures with measuring capability; and which will effectively permit stacking of one container on another.

We claim:

1. A stackable plastic container package including a container including a body having a generally rectangular cross section including a base wall, sidewalls and end walls, and a top wall, the width of the sidewalls being greater than the width of the end walls, said container having a vertical axis, said container having a longitudinal direction in the direction of the width of each side wall, said top wall having an integral neck extending vertically above the top wall defining a dispensing opening adjacent one of said end walls, a closure on said neck, said bottom wall having spaced longitudinally extending integral portions defining a longitudinal recess extending lengthwise of the bottom wall and generally parallel to the sidewalls, said longitudinally extending integral portions and said longitudinal recess on said bottom wall extending for substantially the full width of said sidewalls, said top wall of said body including a first integral projection extending vertically upwardly from lower portions of the top wall and said first projection is adjacent the other end wall, a second centrally located projection extending vertically upwardly from the first projection and said first and second projections define spaced generally horizontal surfaces parallel to each other, said surfaces being positioned above the level of the lower portions of the top wall, the lower portions of the top wall are intermediate the dispensing opening and the first projection, the vertical height of said second centrally located projection and the top of said closure being substantially the same, such that when one container is stacked on another, the horizontal surfaces of the first and second projections of the top wall are engaged by the longitudinally extending spaced portions on the bottom wall of a container stacked thereon.

2. The stackable container package set forth in claim 1 wherein said closure on said neck includes a base wall and a skirt.

3. The stackable container package set forth in claim 2 wherein said closure includes integral measuring means.

4. The stackable container package set forth in claim 3 wherein said integral measuring means comprises an integral frustoconical skirt on said skirt of said closure.

5. The stackable container package set forth in any one of claims 1–4 wherein said closure and neck have interengaging thread means.

* * * * *